United States Patent [19]

Ortiz

[11] 4,034,500

[45] July 12, 1977

[54] AIRBORNE SAUCER-LIKE TOY

[75] Inventor: Nilson V. Ortiz, San Francisco, Calif.

[73] Assignees: Nilson V. Ortiz; Francisco R. Rollojay, San Francisco, Calif.

[21] Appl. No.: 690,703

[22] Filed: May 27, 1976

Related U.S. Application Data

[63] Continuation-in-part of Ser. No. 521,824, Nov. 7, 1974, Pat. No. 3,959,918.

[51] Int. Cl.[2] ..... A63H 33/20

[52] U.S. Cl. ..... 46/86 R; 46/74 D

[58] Field of Search ..... 46/86 R, 86 A, 86 B, 46/86 C, 74 D, 74 R

[56] References Cited

U.S. PATENT DOCUMENTS

| | | | |
|---|---|---|---|
| 700,166 | 5/1902 | Bowers | 46/86 A |

FOREIGN PATENT DOCUMENTS

| | | | |
|---|---|---|---|
| 826,063 | 12/1937 | France | 46/86 A |
| 1,076,324 | 4/1954 | France | 46/86 A |

*Primary Examiner*—F. Barry Shay

*Attorney, Agent, or Firm*—Robert K. Rhea

[57] ABSTRACT

An airborne toy comprising an inverted substantially saucer-shaped body having a flat bottom. A downwardly open recess normally containing a rolled-up toy parachute is closed by flap-like doors hingedly connected to the body. A pair of flexible support strands connected, at one end, with the respective doors extend through a central aperture in the body and are connected together at their other ends for supporting the toy and maintaining the doors closed. Another support strand, entrained across the outer surface of the body, connects the toy parachute with the juncture of the door closing strands for lowering the toy to the surface of the earth when airborne and the parachute is released.

3 Claims, 6 Drawing Figures

FIG. 6

AIRBORNE SAUCER-LIKE TOY

CROSS REFERENCE TO RELATED APPLICATION

This application is a continuation-in-part of an application filed by me in the United States Patent and Trademark Office on Nov. 7, 1974, Ser. No. 521,824, now U.S. Pat. No. 3,959,918 for AIRBORNE TOY.

BACKGROUND OF THE INVENTION

1. Field of the invention.

The invention relates to toys and more particularly to a toy to be airborne when thrown upwardly into the air.

2. Description of the prior art.

The prior art, such as U.S. Pat. Nos. 1,835,717; 2,199,163; 2,949,694 and 3,175,327, disclose projectile-like toys associated with a parachute which, after being launched into the air, unfolds to lower the projectile or figure toward the surface of the earth.

This invention is distinctive over these patents by providing a toy having a substantially saucer-shaped body provided with a recess containing a rolled-up parachute behind flap doors held in closed position by the mass of the body and toy parachute acting on door closing strands during launching. After launching the toy, the toy parachute is released by the doors opening in response to gravitational attraction and the resiliency of the rolled-up parachute.

This invention is distinctive over the above copending application by providing toy parachute retaining door closing support strand means insuring that the doors remains closed until after the toy has been thrown into the air. The released toy parachute, by being connected with the door closing strands, maintains the doors closed when lowering the toy toward the surface of the earth.

SUMMARY OF THE INVENTION

A generally inverted saucer-shaped body formed of lightweight material having a flat bottom is provided with a generally rectangular downwardly open recess. A pair of hingedly connected flap-like doors open and close the recess. The recess contains a rolled-up toy parachute. A pair of door closing flexible strands, each connected at one end with the respective door, is extended through an axial aperture in the body and are connected together at their ends opposite the doors. An elongated parachute strand extends across the exterior of the body and connects the toy parachute shroud lines with the juncture of the closing strands. A toy launching strand is connected with the juncture of the door closing strands for manually launching the toy by a whirling action. A row of circumferentially spaced openings, vertically formed through the body adjacent its periphery, generates a whistling sound as the toy moves through the air.

The principal object of this invention is to provide a flying saucer type toy which may be manually thrown in flight for subsequent release of a folded or rolled-up toy parachute contained by the toy to retard the descent of the toy toward the surface of the earth.

DESCRIPTION OF THE PREFERRED EMBODIMENT

Figure 2:
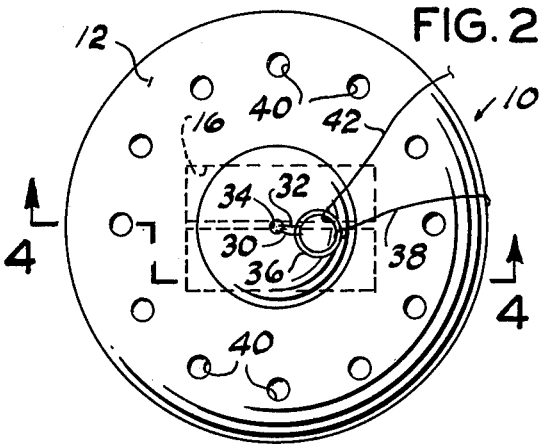
FIG. 2 is a top view of the toy, to a larger scale, illustrating, by dotted lines, the relative position of doors in its bottom surface.
Figure 1:
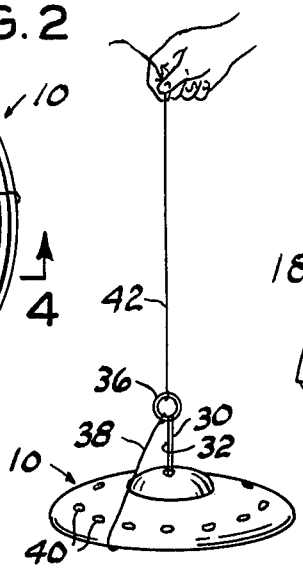
FIG. 1 is a perspective view illustrating the manner in which the toy is manually thrown into flight.
Figure 3:
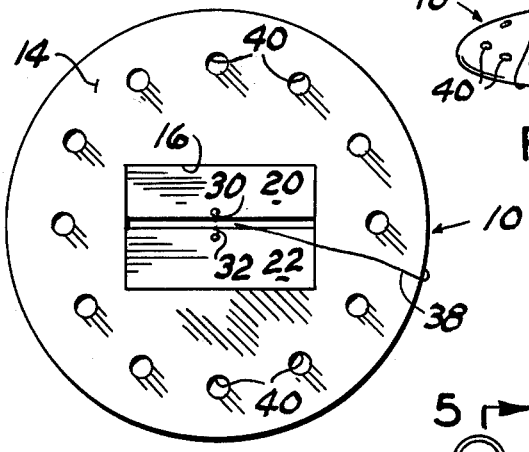
FIG. 3 is a bottom view of the toy.

Like characters of reference designate like parts in those figures of the drawings in which they occur.

In the drawings:

The reference numeral 10 indicates the toy, as a whole, comprising a body, preferably formed of lightweight material, such as balsa wood or plastic, which is substantially saucer-shaped in general configuration having an arcuate upper surface 12 and a generally flat bottom surface 14. The bottom 14 is provided with an inwardly extending generally rectangular recess 16 for normally containing a toy parachute 18 in folded or roller-up form. A pair of flap doors 20 and 22 are hingedly connected with the body at opposite sides of the recess 16. The hinge connection is formed by drilling a pair of holes 24, only one being shown, through the peripheral edge of the body in close spaced parallel relation with respect to the bottom surface 14 and parallel with opposite sides of the recess 16 for receiving a pin 26 which passes through a suitable bore 28 formed in one edge portion of the respective door.

First support strand means comprising a pair of door closing flexible strands 30 and 32, connected at one end with a medial edge portion of the respective door, extend at their other end portions through an axial aperture 34 formed in the body and are connected with a loop or ring 36. The door strands 30 and 32 thus maintain the doors in a closed position by the mass of the toy parachute when the body is supported by the strands.

The toy parachute is connected with the ring by second support means comprising an elongated flexible strand 38 connected at its respective ends to the toy parachute shroud lines 39 and the ring 36 with the major portion of the strand 38 disposed across the outer surface of the body.

A row of circumferentially spaced-apart openings 40 extend vertically through a peripheral portion of the toy for generating a whistling-like sound when the toy passes through the air.

The toy is launched by a launching strand 42 secured at one end to the ring 36 and manually held at its other or free end permitting the toy to be manually launched into the air by a circular whirling action of the toy about an axis formed by the hand of the user and releasing the held end of the launching strand at a selected moment.

Figure 6:
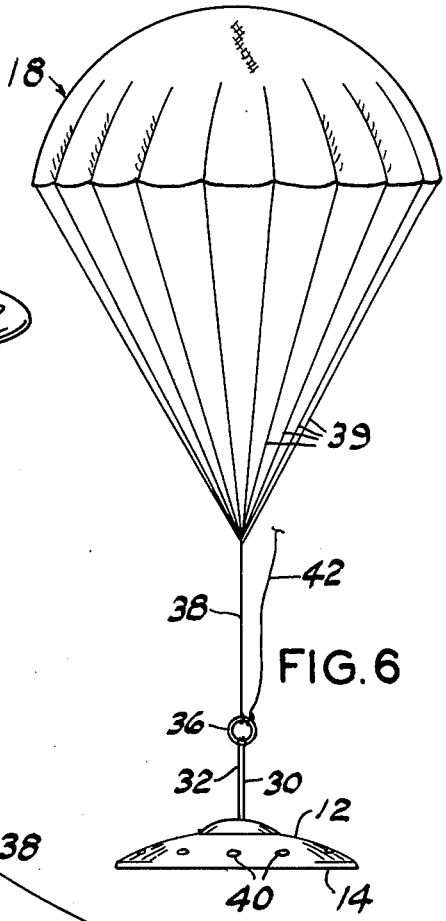
Figure 4:
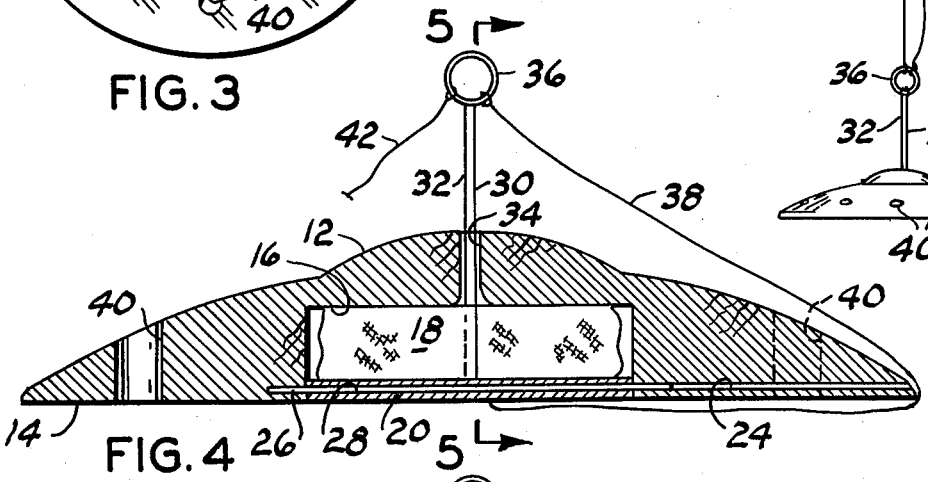
FIG. 4 is a vertical cross sectional view, to an enlarged scale, taken substantially along the line 4—4 of FIG. 2.
Figure 5:
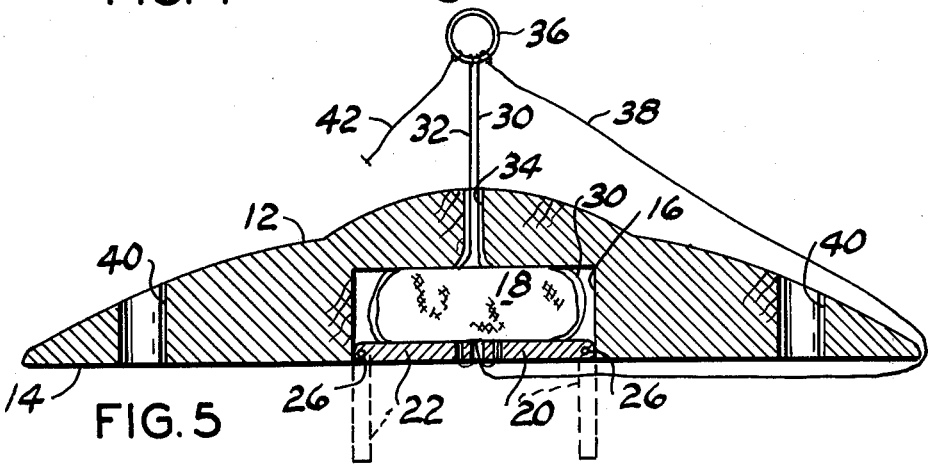
FIG. 5 is a vertical cross sectional view taken substantially along the line 5—5 of FIG. 4 illustrating the doors in open position by dotted lines; and, FIG. 6 is an elevational view illustrating the toy parachute retarding the rate of descent of the toy.

Means are provided tending to open the flap doors after the toy has been launched into the air, for example, the resiliency of the rolled-up toy parachute 18, tending to unroll assisted by gravity and/or centrifugal force and air resistance to the strand 38, biases the doors 20 and 22 toward an opened position, as shown by dotted lines (FIG. 5) permitting the parachute, assisted by air resistance, to fall out of the recess 16 and unfold to its fully opened position, (FIG. 6), for lowering the toy to the surface of the earth.

As the toy parachute unfolds and fills with air its resistance to downward movement and the mass of the toy pulls the doors 20 and 22 to a closed position by the door closing toy support strands 30, 32 and 38.

Obviously the invention is susceptible to changes or alterations without defeating its practicability. Therefore, I do not wish to be confined to the preferred embodiment shown in the drawings and described herein.

I claim:

1. In an aerial toy in combination with a collapsible toy parachute having shroud lines, the improvement comprising:

a generally circular axially apertured body having an arcuate upper surface and a generally flat bottom surface, said body having said shroud lines secured thereto and having a downwardly open recess formed in its bottom surface for nesting said toy parachute when in a collapsed position;

a flap door hingedly connected with said body for opening and closing the recess and means for biasing said door to open position; and, support strand means for supporting said toy during launching, said support strand means being connected with said flap door opposite its hinged connection and associated with said body in a manner to maintain said flap door in recess closed position when the mass of said body is supported via the support strand means and to permit movement of said flap door to a recess open position when said body is airborne.

2. The combination according to claim 1 in which said support strand means comprises:

an elongated first flexible strand longitudinally slidably extending through the body aperture; and, a second elongated flexible strand normally extending transversely across the outer surfaces of said body and connected at its respective ends with the end portion of said first strand opposite said flap door and the toy parachute shroud lines.

3. The combination according to claim 2 and further including:

a ring interposed between and secured to said first and said second flexible support strands.

* * * * *